US005327651A

United States Patent [19]

Favreau

[11] Patent Number: 5,327,651

[45] Date of Patent: Jul. 12, 1994

[54] FOLDING LOCK KNIFE APPARATUS

[76] Inventor: Henry E. Favreau, 88 Squannacook Rd., Shirley, Mass. 01464

[21] Appl. No.: 55,289

[22] Filed: May 3, 1993

[51] Int. Cl.[5] ..... B26B 3/06

[52] U.S. Cl. ..... 30/161; 411/395

[58] Field of Search ..... 30/161, 160, 331; 83/169; 411/395

[56] References Cited

U.S. PATENT DOCUMENTS

| | | | |
|---|---|---|---|
| 512,965 | 1/1894 | Hoyez | 30/161 |
| 1,782,901 | 11/1930 | Kassel | 30/161 X |
| 1,895,342 | 1/1933 | Pelton et al. | 30/161 X |
| 4,730,394 | 3/1989 | Sonner, Jr. | 30/161 |
| 4,979,301 | 12/1990 | Walker | 30/161 |

FOREIGN PATENT DOCUMENTS

| | | | |
|---|---|---|---|
| 366170 | 7/1906 | France | 30/161 |
| 0796488 | 1/1981 | U.S.S.R. | 411/395 |

*Primary Examiner*—Richard K. Seidel
*Assistant Examiner*—Kenneth E. Peterson
*Attorney, Agent, or Firm*—E. Michael Combs

[57] ABSTRACT

A folding lock knife includes a handle member having a handle cavity arranged to receive a lock blade therewithin, wherein the lock blade includes a first end, the first end including an arcuate array of ratchet teeth arranged for selective cooperation with a lock lever having a lock lever foot received between a plurality of such teeth to selectively secure the blade member in a preselected orientation relative to handle portion of the knife assembly.

2 Claims, 4 Drawing Sheets 15
10
11
24
13
2
2

15
17
13
4
19
22
14
3
18
4
12
23
3

FOLDING LOCK KNIFE APPARATUS

BACKGROUND OF THE INVENTION

1. Field of the Invention

The field of invention relates to knife apparatus, and more particularly pertains to a new and improved folding lock knife apparatus wherein the same is directed to permit selective orientation of the blade structure relative to the handle.

2. Description of the Prior Art

Locking knives of various types have been utilized throughout the prior art in a folding arrangement such as indicated in U.S. Pat. Nos. 4,622,744; 4,979,301; 5,025,557; and 5,060,379.

The instant invention attempts to overcome deficiencies of the prior art by providing for a locking lever arranged to permit selective latching of the knife blade in a plurality of angular orientations relative to the handle structure and in this respect, the present invention substantially fulfills this need.

SUMMARY OF THE INVENTION

In view of the foregoing disadvantages inherent in the known types of knife apparatus now present in the prior art, the present invention provides a folding lock knife apparatus wherein the same is arranged to include a knife member having an arcuate array of ratchet teeth permitting ratcheting of the knife blade in an arcuate manner relative to the handle of the invention. As such, the general purpose of the present invention, which will be described subsequently in greater detail, is to provide a new and improved folding lock knife apparatus which has all the advantages of the prior art knife apparatus and none of the disadvantages.

To attain this, the present invention provides a folding lock knife including a handle member having a handle cavity arranged to receive a lock blade therewithin, wherein the lock blade includes a first end, the first end including an arcuate array of ratchet teeth arranged for selective cooperation with a lock lever having a lock lever foot received between a plurality of such teeth to selectively secure the blade member in a preselected orientation relative to the handle portion of the knife assembly.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved folding lock knife apparatus which has all the advantages of the prior art knife apparatus and none of the disadvantages.

It is another object of the present invention to provide a new and improved folding lock knife apparatus which may be easily and efficiently manufactured and marketed.

It is a further object of the present invention to provide a new and improved folding lock knife apparatus which is of a durable and reliable construction.

An even further object of the present invention is to provide a new and improved folding lock knife apparatus which is susceptible of a low cost of manufacture with regard to both materials and labor, and which accordingly is then susceptible of low prices of sale to the consuming public, thereby making such folding lock knife apparatus economically available to the buying public.

Still yet another object of the present invention is to provide a new and improved folding lock knife apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
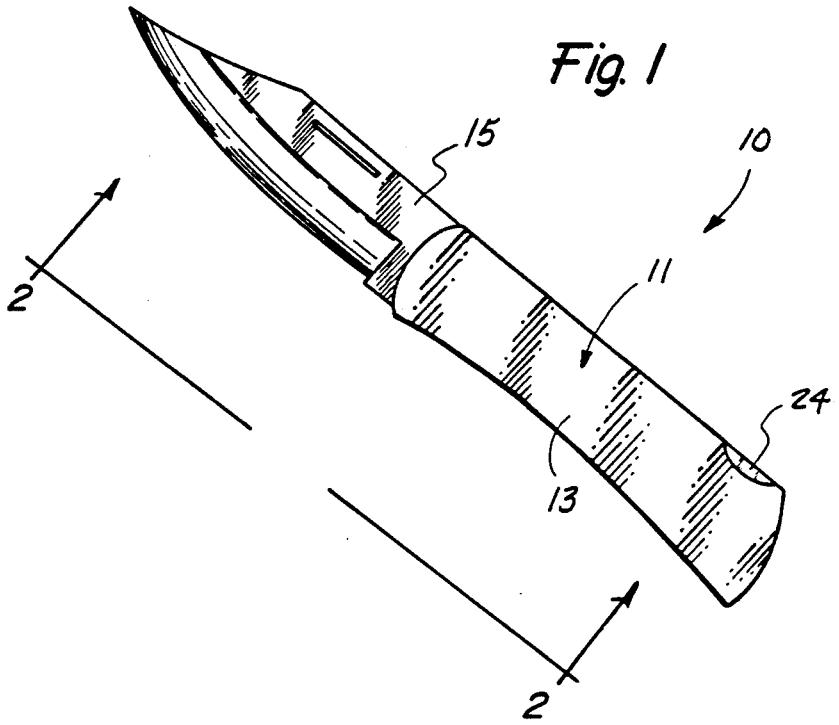
FIG. 1 is an orthographic view of the invention.
Figure 2:
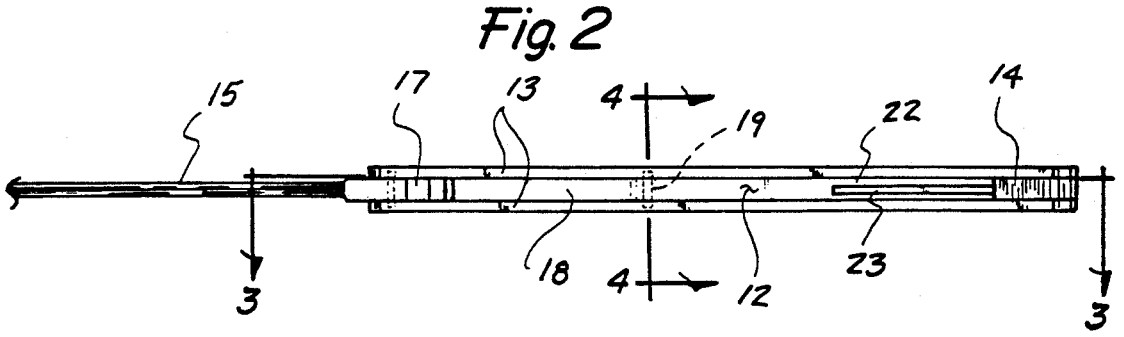
FIG. 2 is an orthographic view, taken along the lines 2—2 of FIG. 1 in the direction indicated by the arrows.
Figure 3:
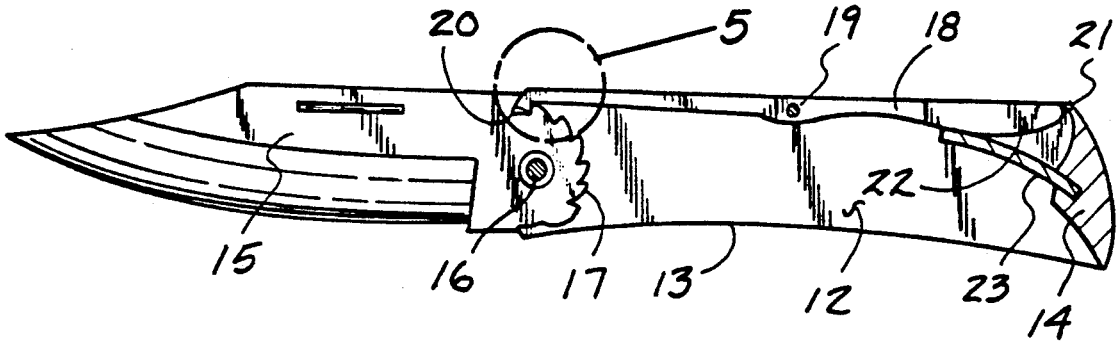
FIG. 3 is an orthographic view, taken along the lines 3—3 of FIG. 2 in the direction indicated by the arrows.
Figure 4:
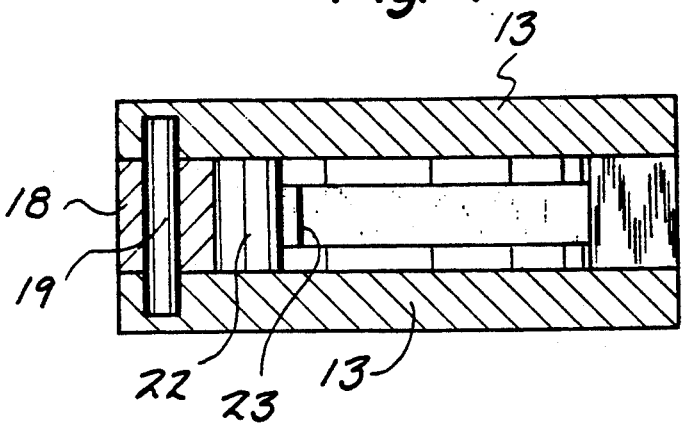
FIG. 4 is an orthographic view, taken along the lines 4—4 of FIG. 2 in the direction indicated by the arrows.

With reference now to the drawings, and in particular to FIGS. 1 to 8 thereof, a new and improved folding lock knife apparatus embodying the principles and concepts of the present invention and generally designated by the reference numeral 10 will be described.

More specifically, the folding lock knife apparatus 10 of the instant invention essentially comprises an elongate handle 11 having a handle cavity 12 oriented between spaced parallel side walls 13, to include a rear connecting plate 14 fixedly mounted between the side walls 13, with an elongate cutting blade 15 having a blade axle 16 pivotally mounting the cutting blade for selective access to the handle cavity 12, wherein the blade axle 16 is positioned at a second end of the side walls 13 orthogonally oriented relative to the side walls 13, wherein the connecting plate 14 is positioned at a first end of the side walls 13. The cutting blade includes an arcuate array of ratchet teeth 17 concentrically oriented about the blade axle 16 for positioning within the cavity 12 for engagement by a lock lever 18, and more specifically, a lock lever first end engaging foot 20. The lock member 18 is pivotal about a lock lever axle 19, that in turn is orthogonally mounted between the side walls 13. A lock lever second end 21 is oriented such that a cam surface 22 is positioned between the lock lever axle 19 and the lock lever second end 21 for engagement with a spring plate 23 that projects relative to the connecting plate 14 within the cavity 12. As illustrated in FIG. 1, side wall recesses 24 are oriented in adjacency relative to the lock lever second end 18 to deflect the lock lever 18 within the cavity against the spring plate 23 to disengage the lock lever first end engaging foot 21 from between a plurality of the ratchet teeth 17.

Figure 5:
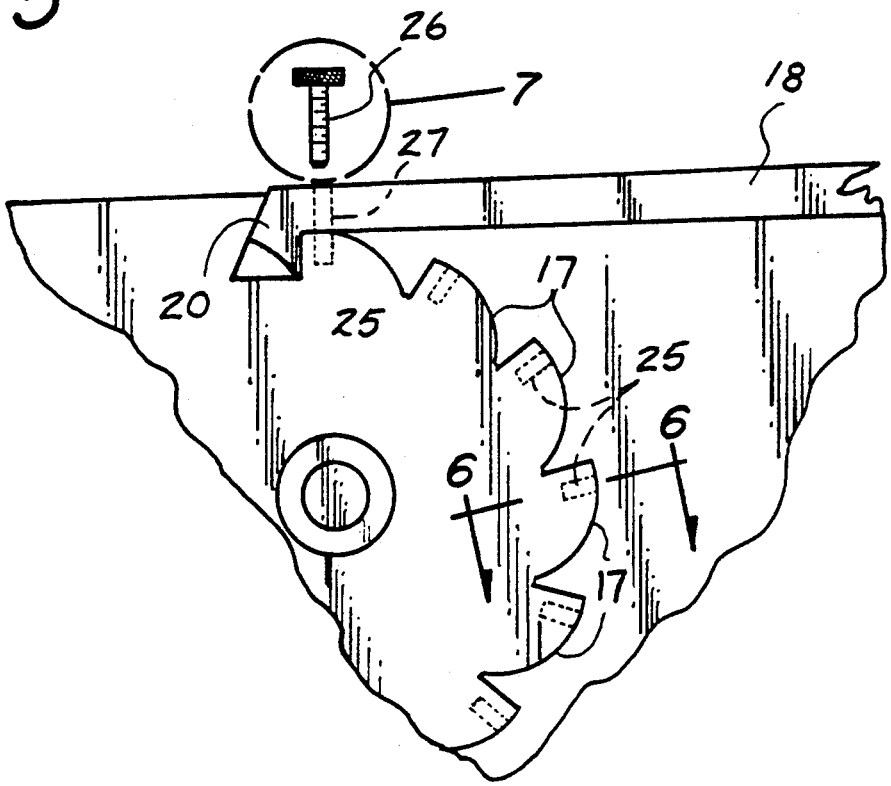
FIG. 5 is an enlarged orthographic view of section 5 as set forth in FIG. 3.
Figure 6:
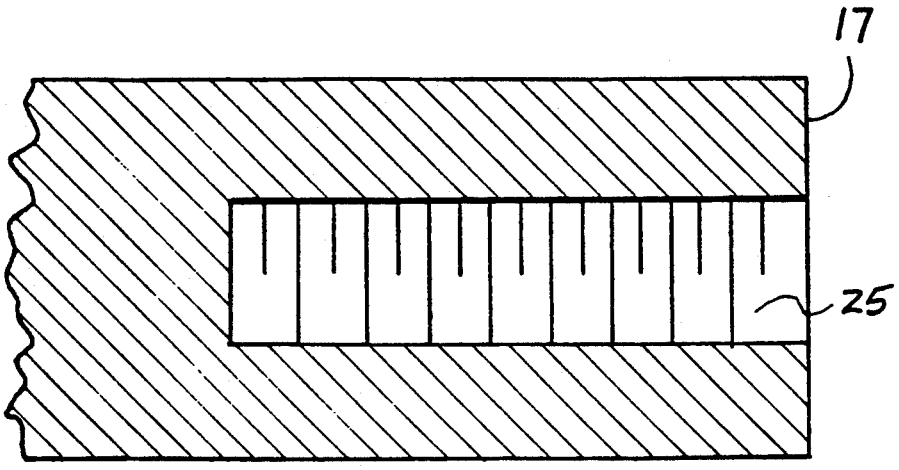
FIG. 6 is an orthographic view, taken along the lines 6—6 of FIG. 5 in the direction indicated by the arrows.

As indicated in the FIG. 5 for example, between adjacent ratchet teeth is oriented an internally threaded bore 25 arranged to receive an externally threaded lock rod 26 directed slidably through a lock rod receiving bore 27 adjacent the first end engaging foot 20. In this manner, the externally threaded lock rod 26 when directed through the lock lever 18 and received within one of the threaded bores 25 fixedly secures the cutting blade 15 relative to the elongate handle 11 in one of a plurality of angular orientations relative to the handle 11.

Figure 7:
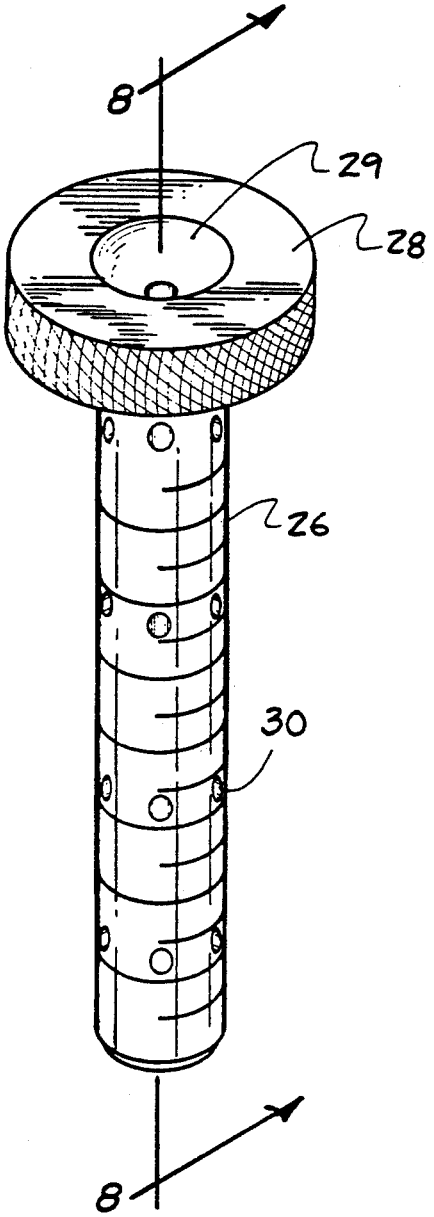
FIG. 7 is an enlarged isometric illustration of section 7 as set forth in FIG. 5.
Figure 8:
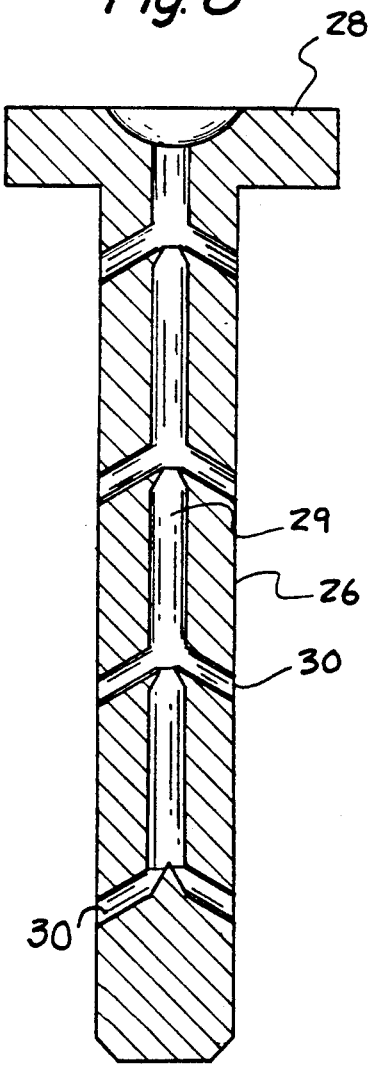
FIG. 8 is an orthographic view, taken along the lines 8—8 of FIG. 7 in the direction indicated by the arrows.

The lock rod 26, as indicated in FIGS. 7 and 8, includes a central bore 29 directed coaxially through the lock rod 26 extending from the lock rod head 28 intersecting a plurality of intersecting conduits 30, wherein the intersecting conduits 30 permit the directing of lubricant fluid from within the lock rod 26 through the conduits 30 for lubrication within the handle 11 without need of removal of the lock rod 26 for access to various remote portions of the ratchet teeth 17 at the first end of the cutting blade 15. The cutting blade, as indicated, includes a second end pointed portion, with a cutting edge extending from the second end pointed portion towards the first end ratchet teeth 17.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A folding lock knife apparatus, comprising, an elongate handle, the handle having spaced parallel side walls, having a handle cavity therebetween, wherein the handle includes a handle first end including a rear connecting plate at the handle first end within the cavity between the side walls, the handle having a handle second end spaced from the first end, and the handle second end including a blade axle directed orthogonally between the side walls, having a cutting blade rotatably mounted about the axle, with the cutting blade having a cutting blade first end positioned between the side walls, having an arcuate array of ratchet teeth concentric about the axle, with lock means arranged for engaging the ratchet teeth for selectively securing the handle in one of a plurality of angular orientations relative to the handle, and the lock means includes a lock lever, the lock lever having a lock lever axle, with the lock lever axle orthogonally oriented relative and between the side walls between the handle first end and the handle second end, with the lock lever having a lock lever first end and a lock lever second end, the lock lever first end including a first end engaging foot for reception between a plurality of said ratchet teeth, and a cam surface at the lock lever second end directed into the cavity between the lock lever axle and the handle first end, and a spring plate fixedly mounted to the rear connecting plate projecting into the cavity for contiguous engagement with the cam surface, and a plurality of threaded bores are directed into the cutting blade first end, wherein an individual of said threaded bores is positioned between adjacent of said ratchet teeth, and the lock lever having a lock rod orthogonally directed through the lock lever in adjacency to the lock lever first end, wherein the lock rod is externally threaded and arranged for reception with one of said threaded bores.

2. An apparatus as set forth in claim 1 wherein the lock rod includes a lock rod head, and the lock rod includes a lock rod central bore oriented coaxially of the lock rod extending from the head, wherein the central bore includes a plurality of intersecting conduits in fluid communication with the central bore extending to an exterior surface of the lock rod permitting lubricant fluid to flow from the central bore through the conduits.

* * * * *